US005996999A

United States Patent [19]

Casey

[11] Patent Number: 5,996,999

[45] Date of Patent: Dec. 7, 1999

[54] COLLECTOR FOR BOARD GAME PIECES

[76] Inventor: Avis Joyce Casey, 2812 Schubert Dr., Silver Spring, Md. 20904

[21] Appl. No.: 09/205,706

[22] Filed: Dec. 4, 1998

Related U.S. Application Data

[60] Provisional application No. 60/067,820, Dec. 5, 1997.

[51] Int. Cl.[6] ..... A63F 9/00

[52] U.S. Cl. ..... 273/148 R

[58] Field of Search ..... 273/148 R, 287, 273/236, 272; 383/36

[56] References Cited

U.S. PATENT DOCUMENTS

| | | | |
|---|---|---|---|
| 2,073,914 | 3/1937 | Wilfley | 383/36 X |
| 4,919,426 | 4/1990 | Vieira | 273/148 R |
| 5,207,425 | 5/1993 | Cohrs | 273/148 R |

*Primary Examiner*—Raleigh W. Chiu

*Attorney, Agent, or Firm*—Michael A. Gollin; Venable

[57] ABSTRACT

A device for collecting board game pieces into a piece bag comprises a flexible board cover with a perimeter defining a first opening that may be secured to the game board, and a collar defining a passageway that may be secured to the piece bag. The board cover is preferably made out of mesh fabric and the perimeter is defined by elastic which when stretched is bigger than the board and when contracted is smaller than the game board. The collar may be secured to the piece bag by VELCRO or snaps. Alternatively, the collar is secured to the bag by an exterior bag formed integrally with the board cover section. The invention contemplates a board game packaged with such a device. A method for collecting pieces from a game board into a piece bag comprises securing the piece bag to a collector bag having a funnel opening, securing the collector bag to the game board, inverting the game board so that the pieces fall into the collector bag device, through the funnel opening, and into the piece bag, removing the collector bag from the game board, and removing the piece bag from the collector bag.

9 Claims, 1 Drawing Sheet

FIG. 3-A

COLLECTOR FOR BOARD GAME PIECES

This application claims benefit of Provisional Appln. Ser. No. 60/067,820 filed Dec. 5, 1997.

BACKGROUND OF THE INVENTION

The present invention relates to a device for collecting pieces used in board games for convenient storage and use. More specifically, the invention relates to a tile catcher for use with SCRABBLE boards and other games.

In many board games, tiles, marbles, or other pieces must be removed from the playing surface at the end of the game, to prepare for the next game or for storage. If the board is smooth, it is an option to sweep the pieces by hand into a bag or box, but for SCRABBLE and some other games in which the pieces are set into recessed spaces during playing, it is impossible to sweep the pieces off the board. They must be picked off by the handfull, which is tedious, or the board must be tipped or inverted to collect the pieces, which tends to cause spillage.

U.S. Pat. No. 4,919,426 discloses a dust cover for a board game including a pouring spout for collecting the pieces. The rigid design of this device makes it inconvenient.

Some SCRABBLE players use a mesh bag to place over the game board. When the board is tipped into the bag, the tiles are collected conveniently. One version is simply a square bag. Another version is a rectangular pouch with an extended back flap like an envelope. However, to transfer the tiles into the tile bag for storage or further use requires manipulation and may lead to spillage.

SUMMARY OF THE INVENTION

Extensive observation of players made clear the need for an improved device. A piece catcher according to the invention is adapted for use with SCRABBLE and similar board games having a piece bag. It is made of a flexible material having one opening large enough to fit over the game board and another opening small enough to fit inside the piece bag, with means for securing the collector to both the game board and the piece bag.

The piece collector of the invention gathers pieces from a board in a large flexible enclosure, and funnels them through a smaller passage into a piece bag. The piece collector is convenient, lightweight, and inexpensive to make. It is adaptable to round and square boards, and to piece bags of various sizes.

A device for collecting board game pieces into a piece bag comprises a flexible board cover with a perimeter defining a first opening that may be secured to the game board, and a funnel opening defining a passageway that may be secured to the piece bag. The board cover is preferably made out of mesh fabric and the perimeter is defined by elastic which causes the fabric to be shirred, and when stretched is bigger than the board and when contracted is smaller than the game board. The funnel opening is preferably a collar adapted to be secured to the piece bag by VELCRO, a hook-and-loop fastener or snaps. Alternatively, the funnel opening is secured to the bag by an exterior bag formed integrally with the board cover section. The invention contemplates a board game packaged with such a device. A device according to the invention comprises means for covering a game board, means for securing the covering to the game board, means for passing pieces from the game board into a piece bag, and means for securing the piece bag to the means for covering the game board.

A method for collecting pieces from a game board into a piece bag comprises securing the piece bag to a collector bag having a funnel opening, securing the collector bag to the game board, inverting the game board so that the pieces fall into the collector bag device, through the funnel opening, and into the piece bag, removing the collector bag from the game board, and removing the piece bag from the collector bag.

Further objectives and advantages will become apparent from a consideration of the description and drawings.

BRIEF DESCRIPTION OF THE DRAWINGS

The invention is better understood by reading the following detailed description with reference to the accompanying figures, in which like reference numerals refer to like elements throughout, and in which:

FIG. 3-A shows a cutaway of the bag assembly.

DETAILED DESCRIPTION OF THE PREFERRED EMBODIMENTS

Figure 1:
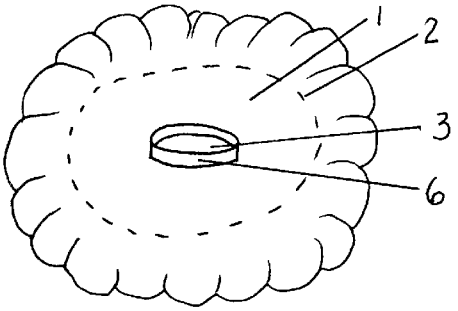
FIG. 1 illustrates a round embodiment of the invention in relaxed state.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

A purpose of the invention is to collect titles, marbles or other pieces used in board games such as SCRABBLE® board games, dominos, monopoly, checkers, or backgammon. It may also be used for other small parts arrayed in compartments on a flat board. The piece collector is a square (or circle or other suitable shape) made of net with elastic at the corners (or around the circumference). The size is slightly larger than that of the game board so that it may be put on the board. The elastic allows it to fit snugly onto the game board. The piece catcher is low-cost and simple to construct using a sewing machine. It satisfies a longstanding need to pick up tiles quickly and return them to a bag.

Net or mesh material is the preferred fabric because of its transparency. It permits players to see that all the titles have been returned to the piece bag. The piece bag, or tile bag, is opaque in SCRABBLE so players cannot see what letters they are choosing.

In FIG. 1, board cover 1 is round, and collar 6 is formed in passageway 3, sized to fit inside the piece bag. Collar 6 may be lined on the outside with velcro, snaps, a friction fitting or other means for fastening.

Figure 2:
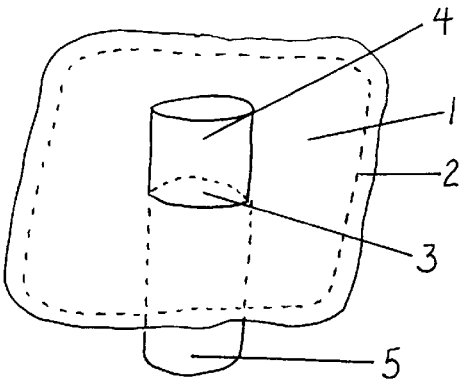
FIG. 2 illustrates a square embodiment of the invention in stretched state.

In FIG. 2, board cover 1 is made of a square of mesh material or other fabric or flexible material that permits easy observation of what is inside. Perimeter 2 is hemmed with elastic or other stretchable material whose maximum stretched size is selected to fit snugly over the game board (shown in stretched configuration). Passageway 3 is a hole in about the center of board cover 1, and passes to integral bag 5 sized to hold a piece bag. Attached tube 4 is slightly smaller in diameter and length than integral bag 5, and is shown inside out.

Figure 3:
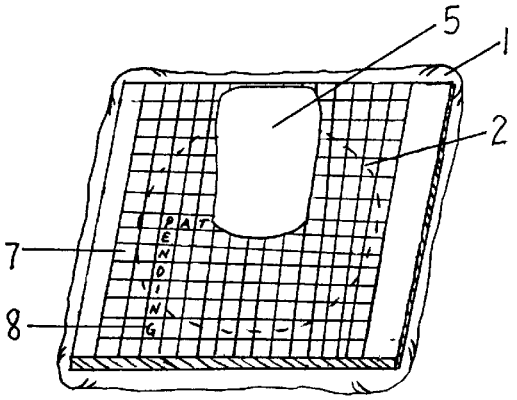
FIG. 3 shows the piece catcher placed on a game board.

In FIG. 3, a piece collector made of transparent material as in FIG. 2 is shown in use on board 7. Elastic perimeter 2 is shown in contracted position beneath the board, securing it to the board. Pieces 8 are shown in place on board 7. As shown in cutaway FIG. 3-A, prior to use, piece bag 9 is placed inside integral bag 5 and attached tube 4 is turned right side in, inside the lip of piece bag 9. Attached tube 4 is shown inverted and fitting inside piece bag 9, with integral bag 5 holding piece bag 9 in place. When board 7 is inverted, the tiles 8 fall into the board cover 1, and through attached tube 4 into piece bag 9. The device may be removed from the game board, and the piece bag may be removed from the bag holder for further use.

Figure 4:
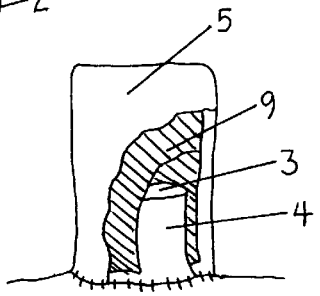
FIG. 4 shows pieces being poured from the piece catcher into the piece bag.
Figure 4:
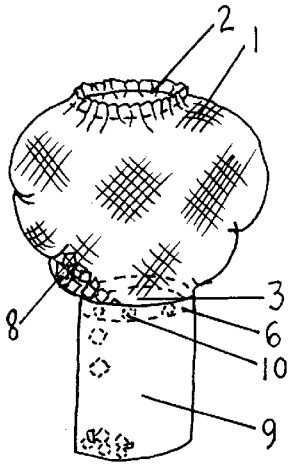

FIG. 4 shows a piece collector as in FIG. 1 after removal from the game board. Pieces 8 are shown falling through collar 6 into piece bag 9. Snaps 10 are shown on collar 6, with corresponding snaps on the lip of piece bag 9 to secure it. Other securing means are appropriate as is apparent to a person of ordinary skill.

A method of using the second embodiment of the piece catcher of the invention is as follows:

1. Place tile bag 9 in the holder, integral bag 5, of the tile catcher. Invert attached tube 4 inside the tile bag.
2. Place tile catcher securely on the game board with elastic fitted at the corners of the game board.
3. Turn the game board upside down and allow all the tiles to collect in board cover 1 and slide down the passage into the tile bag.
4. Take the tile bag out of the tile catcher and play again, or put tile bag away for storage.

Construction of the piece collector may be very simple. In the first embodiment, the collar is formed from the mesh fabric, or other fabric, and has a fastener such as VELCRO, snaps, or a ring attached to it. Alternatively, the piece bag may be held on to the collar by hand.

The proportions of the sections of the device are as follows. The board cover piece is slightly larger than the game board, and the elastic is sized to secure the cover to the board, like a fitted sheet. A cover of the same shape as the board is preferred, but a round cover could be used for a square board, or vice versa. Means other than elastic could be used to secure the cover to the board, such as VELCRO, a friction sleeve or fitting, or a draw string, or making the cover big enough to hold the board and catch the pieces without spilling. The hole for the collar/passageway portion is sized just smaller than the piece bag lip, so that it may fit inside. VELCRO, snaps, a friction sleeve or fitting, or a draw string, can be used.

In the embodiment using an integral bag to hold the piece bag, the integral bag is sized slightly larger than the piece bag. The attached tube is sized slightly smaller than the piece bag.

The embodiments illustrated and discussed in this specification are intended only to teach those skilled in the art the best way known to the inventors to make and use the invention. Nothing in this specification should be considered as limiting the scope of the present invention. Modifications and variations of the above-described embodiments of the invention are possible without departing from the invention, as appreciated by those skilled in the art in light of the above teachings. It is therefore to be understood that, within the scope of the claims and their equivalents, the invention may be practiced otherwise than as specifically described.

What is claimed is:

1. A device for collecting board game pieces into a piece bag, comprising:

a flexible board cover with a perimeter defining a first opening that may be secured to the game board, a collar defining a passageway comprising a fastener for the piece bag.

2. A device according to claim 1, wherein the perimeter of the board cover is shirred with elastic which when stretched is bigger than the board and when contracted is smaller than the game board.

3. A device according to claim 1 made out of mesh fabric.

4. A device according to claim 1 wherein the collar is a single layer.

5. A device according to claim 1, wherein the fastener is a hook-and-loop-fastener, snaps, a friction fitting, or a drawstring.

6. A device according to claim 1, wherein the collar is secured to the bag by an exterior bag formed integrally with the board cover section.

7. A board game packaged with a device according to claim 1.

8. A device comprising:

means for covering a game board, means for securing the covering means to the game board, means for passing pieces from the game board into a piece bag, and means for securing the piece bag to the means for covering the game board.

9. A method for collecting pieces from a game board into a piece bag comprising:

securing the piece bag to a collector bag having a funnel opening, securing the collector bag to the game board, inverting the game board so that the pieces fall into the collector bag device, through the funnel opening, and into the piece bag, removing the collector bag from the game board, and removing the piece bag from the collector bag.

* * * * *